US005155470A

United States Patent [19]

Tuttle

[11] Patent Number: 5,155,470

[45] Date of Patent: Oct. 13, 1992

[54] MAILBOX SIGNALING APPARATUS

[76] Inventor: Charles D. Tuttle, 210 Bower Rd., Poughkeepsie, N.Y. 12603

[21] Appl. No.: 685,884

[22] Filed: Apr. 16, 1991

[51] Int. Cl.[5] ..... G08B 1/08

[52] U.S. Cl. ..... 340/539; 340/569; 340/815.31; 340/326

[58] Field of Search ..... 340/326, 328, 329, 330, 340/539, 569, 573, 691, 693, 286.01, 286.02, 286.06, 286.11, 436, 815.01, 815.31

[56] References Cited

U.S. PATENT DOCUMENTS

| | | | |
|---|---|---|---|
| 3,624,635 | 11/1971 | Less | 340/326 |
| 3,911,425 | 10/1975 | Muncheryan | 340/326 |
| 3,913,092 | 10/1975 | Klingenberg | 340/573 |
| 4,154,393 | 5/1979 | Darvishian | 340/569 |
| 4,611,265 | 9/1986 | Davis | 40/553 |
| 4,730,184 | 3/1988 | Bach | 340/691 |
| 4,839,630 | 6/1989 | Miller | 340/326 |
| 4,931,780 | 6/1990 | LaMont et al. | 340/691 |

*Primary Examiner*—Jin F. Ng
*Assistant Examiner*—Dov Popovici
*Attorney, Agent, or Firm*—Leon Gilden

[57] ABSTRACT

A rural mailbox includes a housing mounted medially to an upper surface of the mailbox, wherein the housing includes a receiver operative through a transmitter to effect actuation of an elongate illumination bulb extending substantially coextensively of the housing, with the housing including indicia openings directed through side walls of the housing to effect signaling and enhanced recognition of the mailbox during emergency situations. The organization may optionally include a further housing, with a door plate pivotally mounted therethrough, wherein a further receiver cooperative with a solenoid rod effects selective opening of the door plate and directing of an illumination balloon member therethrough to enhance operative recognition of the mailbox and associated dwelling.

3 Claims, 4 Drawing Sheets

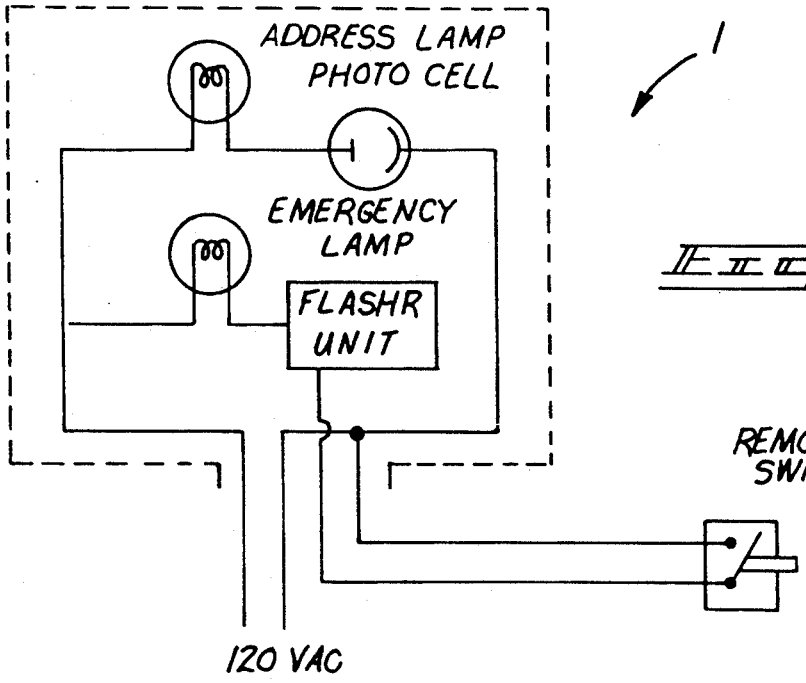
FIG 1
PRIOR ART
FIG 2
PRIOR ART
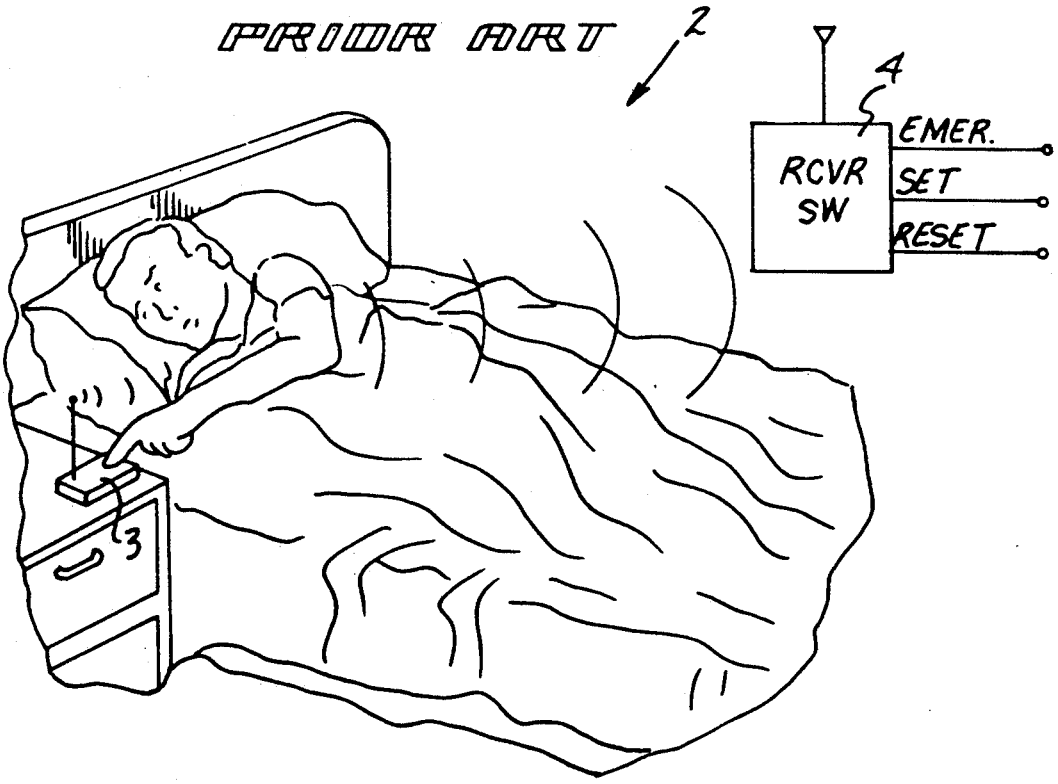

MAILBOX SIGNALING APPARATUS

BACKGROUND OF THE INVENTION

1. Field of the Invention

The field of invention relates to signal apparatus, and more particularly pertains to a new and improved mailbox signaling apparatus wherein the same provides an organization wherein a mailbox structure is utilized to selectively actuate a signal structure to effect recognition of a mailbox and associated address.

2. Description of the Prior Art

Signal devices have been utilized in the prior art to effect indication of an emergency or the like for providing indication of location of an individual. Such apparatus is typified in the prior art by U.S. Pat. No. 4,611,265 to Davis wherein a lighted display apparatus is mounted within a housing utilizing a remote controlled circuit operative by transmitter.

U.S. Pat. No. 4,730,184 to Bach sets forth for an audio/visual alarm system operative through a remote control unit.

U.S. Pat. No. 4,839,630 to Miller sets forth an emergency signal device such as utilized in a mobile home for positioning overlying a doorway of the home for indication of an emergency situation.

U.S. Pat. No. 4,931,780 to Lamont, et al. sets forth an illuminated address identifier including indicia illuminated by an address at night in operative association with dialing of a 911 emergency code.

As such, it may be appreciated that there continues to be a need for a new and improved mailbox signaling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of signal apparatus now present in the prior art, the present invention provides a mailbox signaling apparatus wherein the same is arranged for effecting enhanced indication of an address or location in reduced lighting environments, such as evening hours and the like. As such, the general purpose of the present invention, which will be described subsequently in greater detail, is to provide a new and improved mailbox signaling apparatus which has all the advantages of the prior art signal apparatus and none of the disadvantages.

To attain this, the present invention provides a rural mailbox including a housing mounted medially to an upper surface of the mailbox, wherein the housing includes a receiver operative through a transmitter to effect actuation of an elongate illumination bulb extending substantially coextensively of the housing, with the housing including indicia openings directed through side walls of the housing to effect signaling and enhanced recognition of the mailbox during emergency situations. The organization may optionally include a further housing, with a door plate pivotally mounted therethrough, wherein a further receiver cooperative with a solenoid rod effects selective opening of the door plate and directing of an illumination balloon member therethrough to enhance operative recognition of the mailbox and associated dwelling.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mailbox signaling apparatus which has all the advantages of the prior art signal apparatus and none of the disadvantages.

It is another object of the present invention to provide a new and improved mailbox signaling apparatus which may be easily and efficiently manufactured and marketed.

It is a further object of the present invention to provide a new and improved mailbox signaling apparatus which is of a durable and reliable construction.

An even further object of the present invention is to provide a new and improved mailbox signaling apparatus which is susceptible of a low cost of manufacture with regard to both materials and labor, and which accordingly is then susceptible of low prices of sale to the consuming public, thereby making such mailbox signaling apparatus economically available to the buying public.

Still yet another object of the present invention is to provide a new and improved mailbox signaling apparatus which provides in the apparatus and methods of the prior art some of the advantages thereof, while simultaneously overcoming some of the disadvantages normally associated therewith.

Still another object of the present invention is to provide a new and improved mailbox signaling apparatus wherein the same provides visual indication of an address in evening hours by utilizing a single or plurality of signal devices in association with a rural type mailbox.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic plan view of a prior art circuit organization for use in signaling structure.

FIG. 2 is an isometric illustration of a prior art signal apparatus.

DESCRIPTION OF THE PREFERRED EMBODIMENT

Figure 3:
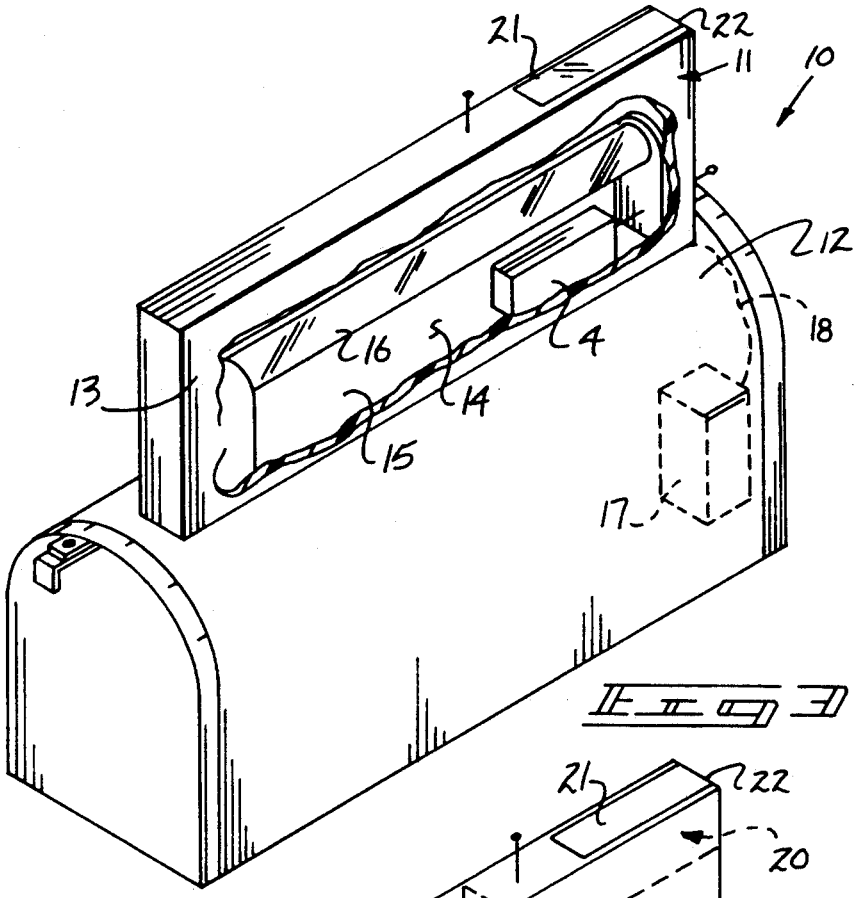
FIG. 3 is an isometric illustration, partially in section, of the instant invention.
Figure 4:
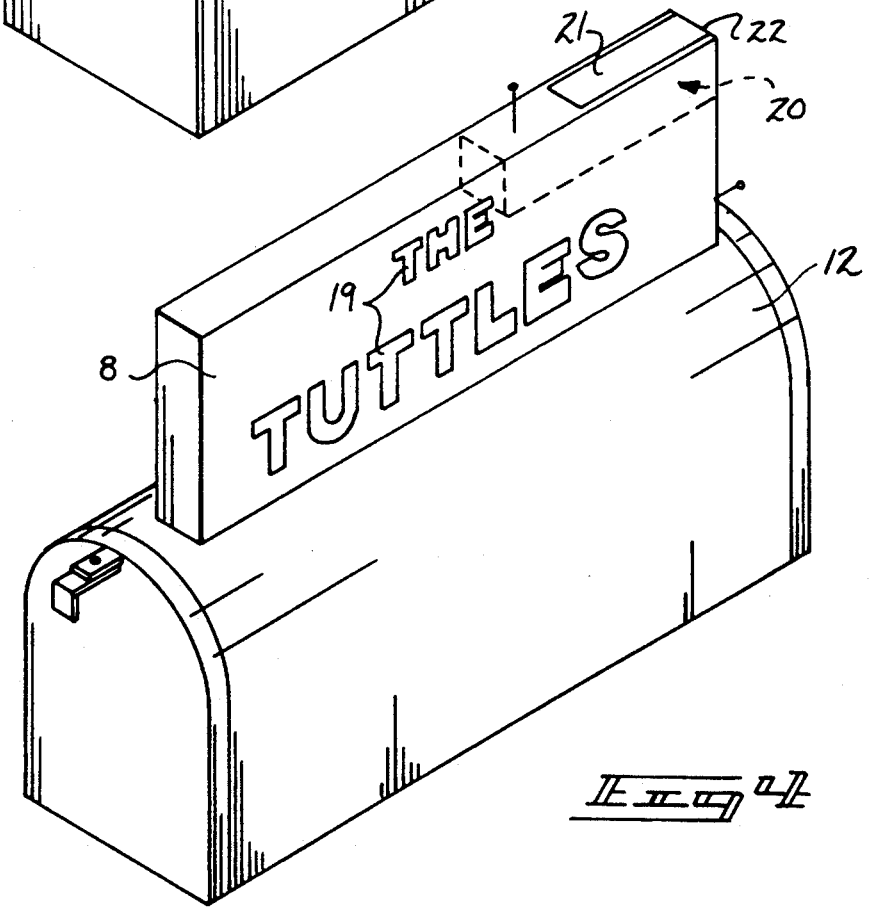
FIG. 4 is an isometric illustration of the instant invention.
Figure 5:
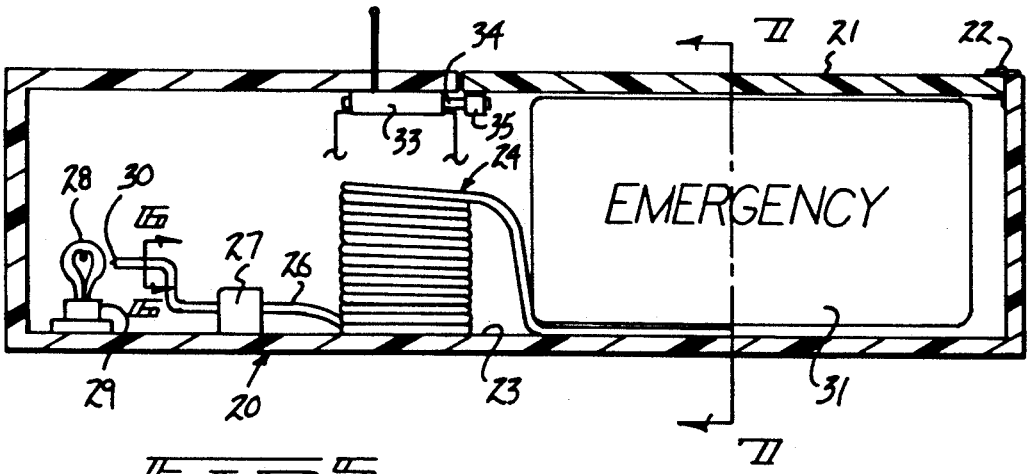
FIG. 5 is an orthographic cross-sectional illustration of the auxiliary housing and signal structure utilized by the instant invention.
Figure 6:
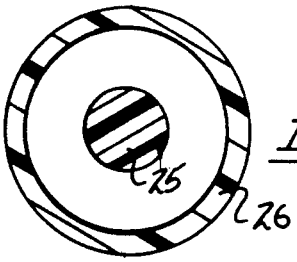
FIG. 6 is an orthographic view, taken along the lines 6—6 of FIG. 5 in the direction indicated by the arrows.
Figure 7:
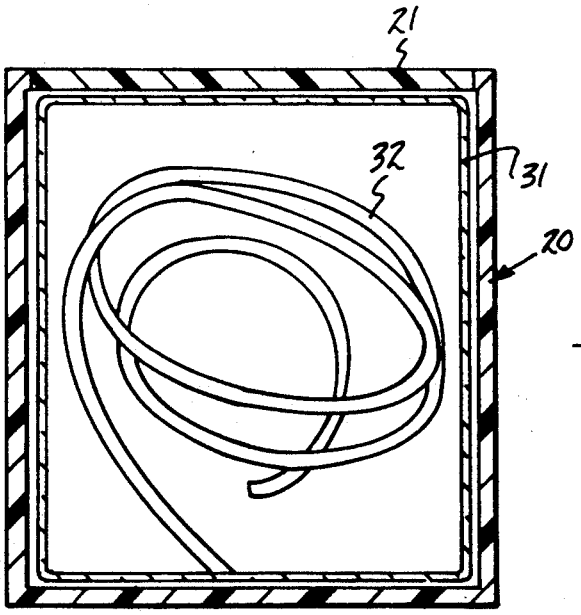
FIG. 7 is an orthographic view, taken along the lines 7—7 of FIG. 5 in the direction indicated by the arrows.

With reference now to the drawings, and in particular to FIGS. 1 to 8 thereof, a new improved mailbox signaling apparatus embodying the principles and concepts of the present invention and generally designated by the reference numeral 10 will be described.

FIG. 1 illustrates typical circuitry utilized in a prior art device, as presented in U.S. Pat. No. 4,611,265, in association with an illumination organization that is operative from a remote switch to effect illumination of indicia relative to an address, as presented in that patent and as illustrated in FIG. 1, numeral 1. FIG. 2 sets forth a further example of a remote controlled alarm organization 2 utilizing a remote transmitter 3 and a receiver 4, as presented in U.S. Pat. No. 4,730,184, for actuation of an audio/visual alarm organization.

More specifically, the mailbox signaling apparatus 10 of the instant invention essentially comprises an elongate housing 11 formed of a generally parallelepiped configuration, including spaced side walls 13 defining a housing cavity 14 therewithin. The housing 11 is mounted longitudinally of an uppermost exterior surface of a rural mailbox exterior wall 12. The housing 11 is further provided with a housing floor 15 mounting a receiver unit 4 thereon, with the receiver unit's antenna directed exteriorly of the housing cooperative with a transmitter unit (not shown) of a type as illustrated in FIG. 2 and incorporated herein by reference.

The housing 11 includes an elongate first illumination bulb 16 directed substantially coextensively through the cavity 14 medially and parallel to the side walls 13. The mailbox may include a battery housing and battery 17 therewithin for electrical communication with the housing 11 to permit utilization of a greater capacity battery that is readily serviced and cooperative with the illumination bulb 16 through a conventional electrical transmission line 18.

The housing 11 includes indicia openings 19 (see FIG. 4) indicating individual housing to enhance ease of visual association of the apparatus relative to a desired address in a typical rural setting. In use therefore, actuation of a transmitter 3 effects selective illumination of the first illumination bulb 16 for illumination of the indicia openings 19.

Optionally, an auxiliary housing 20 is utilized, with a door plate 21 pivotally mounted through a hinge member 22, with the door plate 21 coextensive with a top surface of the housing 20. The auxiliary housing 20 includes an auxiliary housing floor 23 mounting a fiber optic coil 24 thereon. The fiber optic coil is formed of a fiber optic cable 25 defined by a polymeric flexible sheath 26 mounting a fiber optic cable 25 therethrough. The polymeric sheath 26 includes a cable anchor member 27 mounting and fixing the cable to the auxiliary housing floor 23. A second illumination bulb 28 is provided to direct illumination through the fiber optic cable 25, with a positioning link 29 mounted to a fiber optic cable rear terminal end 30 to position and align the rear terminal end of the fiber optic cable 25 relative to the second illumination bulb 28.

Figure 8B:
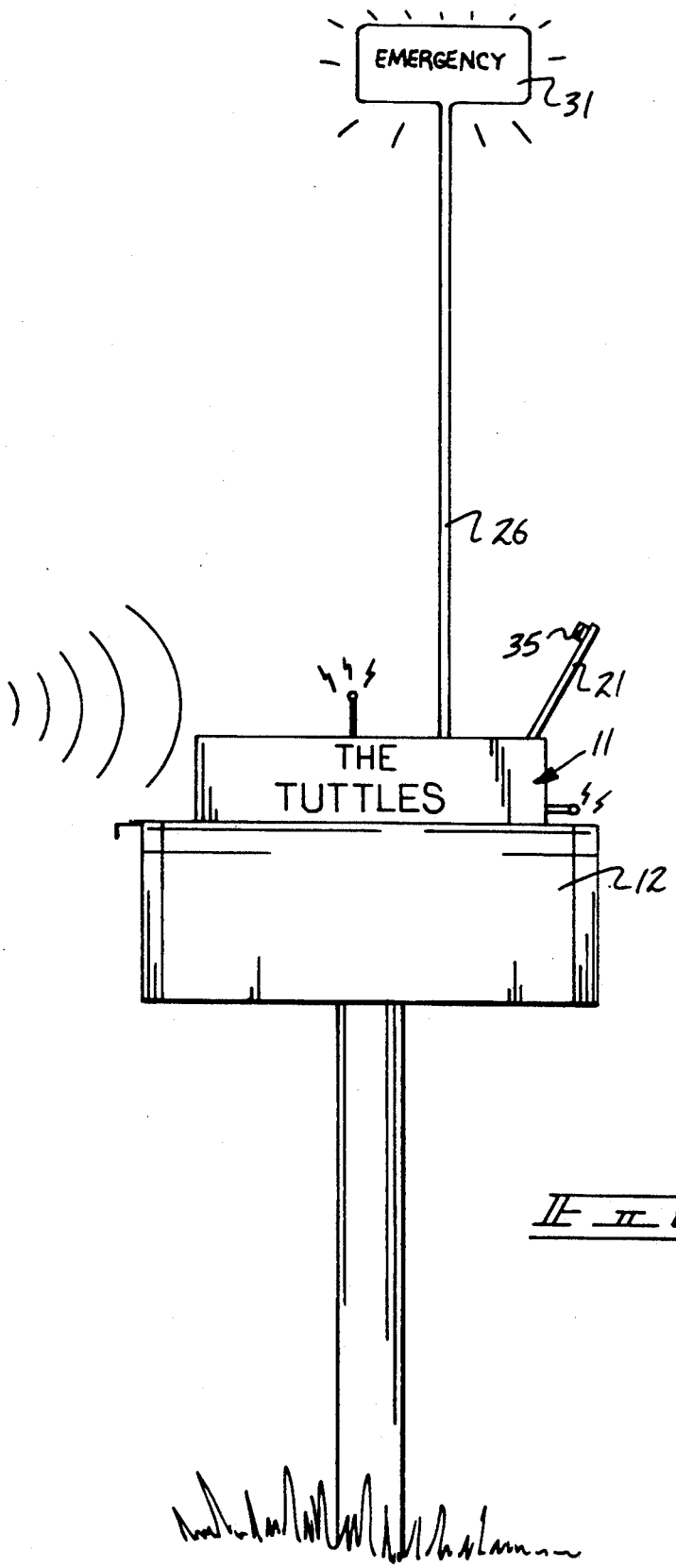
FIG. 8 is an orthographic side view, taken in elevation, of an operative configuration of the instant invention in use.

Mounted within the auxiliary housing 20 and positioned below the auxiliary housing door plate 21 is a helium filled translucent balloon member 31. The translucent balloon member 31 includes a predetermined length defining a rear end portion 32 of the cable 25 contained within the balloon 31. A second receiver and solenoid 33 is mounted, wherein the solenoid includes a solenoid rod 34 that is directed through a cylindrical latch ring 35 secured to a forward lower terminal end of the door plate 21 whereupon actuation of the transmitter unit 3, the rod 34 is retracted permitting the door plate 21 to open with the balloon 31 forcing the door open to an elevated position, as illustrated in FIG. 8, with the fiber optic cable 25 effecting illumination within the balloon 31. In this manner, simultaneous illumination of the indicia openings 19 and of the translucent balloon 31 is simultaneously effected to enhance indication of a particular geographical location.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mailbox signaling apparatus, comprising in combination, an elongate mailbox defined by an exterior wall, the exterior wall including an elongate housing mounted longitudinally of and to an upper end portion of the exterior wall, the housing including spaced housing side walls defining a cavity therewithin, the housing including a housing floor defining the cavity within the housing above the housing floor, an elongate illumination bulb directed medially of and substantially parallel and coextensive with the housing side walls, a receiver unit mounted within the housing cavity, a transmitter unit operative to effect selective actuation of the elongate illumination bulb, a battery housing and battery mounted within the mailbox for directing electrical energy to the elongate illumination bulb through the receiver unit, indicia openings directed through each side wall, and the housing cavity includes an auxiliary housing contained within, and the housing including a housing top wall, and the auxiliary housing including a door plate hingedly mounted to the auxiliary housing coextensive with the housing top wall, and the door plate including a hinge member mounting the door plate to the auxiliary housing, and the auxiliary housing further including an auxiliary housing floor with a fiber optic coil mounted on the auxiliary housing floor, and the fiber optic coil including a polymeric sheath containing a fiber optic cable directed therethrough, and the fiber optic cable including a fiber optic cable rear terminal end, and a second illumination bulb mounted within the auxiliary housing, with the fiber optic cable rear terminal end mounted adjacent the second illumination bulb to direct illumination through the fiber optic cable, and signal means mounted within the auxiliary housing below the door plate operative for projection through the door plate operative for projection through the door plate upon actuation of the transmitter unit.

2. An apparatus as set forth in claim 1 including a second receiver including a solenoid, the solenoid including a solenoid rod, the solenoid rod reciprocatably mounted within the solenoid, and the door plate including a cylindrical latch ring secured to a bottom surface of the door plate, and the solenoid rod operative from a first position directed through the cylindrical latch ring to a second position spaced from the cylindrical latch ring to permit unlatching of the door plate.

3. An apparatus as set forth in claim 2 wherein the signal means includes a helium filled translucent balloon, the helium filled translucent balloon including a predetermined length of the fiber optic cable directed therewithin defining a rear end portion to effect illumination within the balloon when the balloon projects through the door plate.

* * * * *